US005775125A

United States Patent [19]

Sakai et al.

[11] Patent Number: 5,775,125

[45] Date of Patent: Jul. 7, 1998

[54] INTEGRATED AIR CONDITIONER

[75] Inventors: Hirokazu Sakai, Kyoto; Takashi Sugio, Kusatsu, both of Japan

[73] Assignee: Matsushita Industrial Electric Co., Ltd., Japan

[21] Appl. No.: 759,962

[22] Filed: Dec. 3, 1996

[51] Int. Cl.[6] ..... F25D 17/04

[52] U.S. Cl. ..... 62/410; 62/262; 62/426

[58] Field of Search ..... 62/262, 296, 404, 62/407, 410, 426, 428, 429

[56] References Cited

U.S. PATENT DOCUMENTS

| | | | |
|---|---|---|---|
| 2,210,458 | 8/1940 | Keilholtz | 62/262 |
| 3,052,104 | 9/1962 | Carini | 62/262 |
| 3,208,236 | 9/1965 | Frigerio | 62/262 |
| 3,566,614 | 3/1971 | Imral | 62/262 |
| 3,602,006 | 8/1971 | Metcalfe | 62/262 |
| 3,756,039 | 9/1973 | Riello | 62/262 |
| 4,505,129 | 3/1985 | Yamane et al. | 62/280 |

FOREIGN PATENT DOCUMENTS

| | | | |
|---|---|---|---|
| 62529 | 4/1985 | Japan | 62/262 |
| 165439 | 8/1985 | Japan | 62/262 |
| 165441 | 8/1985 | Japan | 62/262 |
| 60165439 A | 8/1985 | Japan . | |
| 190225 | 8/1986 | Japan | 62/262 |
| 406193903 | 7/1994 | Japan | 62/262 |

*Primary Examiner*—William Doerrler
*Attorney, Agent, or Firm*—Parkhurst & Wendel

[57] ABSTRACT

An integrated air conditioner is provided which realizes an improvement in the indoor- and outdoor-side ventilating circuits, an enhancement in air quantity performance, a reduction in noise, an enhancement in heat exchanging ability, compacting, and simplification in an installing operation. The integrated air conditioner has an indoor-side ventilating circuit (4) which is constituted by an indoor-side heat exchanger (5), two indoor-side air blowers (6) with centrifugal fans, an indoor-side suction port (2), and an indoor-side blowoff port (3); an outdoor-side ventilating circuit (9) which is constituted by an outdoor-side heat exchanger (10), an outdoor-side air blower (6) with an axial-flow fan, an outdoor-side suction port (7), and an outdoor-side blowoff port (8); ducts for leading the indoor-side suction port (2) and the indoor-side blowoff port (3) to an indoor side; and a compressor (12). The indoor-side ventilating circuit (4), the outdoor-side ventilating circuit (9), and the compressor (12) are provided outdoors.

12 Claims, 18 Drawing Sheets

INTEGRATED AIR CONDITIONER

FIELD OF THE INVENTION

The present invention relates to an integrated air conditioner, and particularly to the internal structure thereof.

BACKGROUND OF THE INVENTION

A conventional integrated air conditioner is shown, for example, in Japanese Patent Application Laid-Open No. 60-165439. In the main body of the integrated air conditioner, an indoor-side ventilating circuit and an outdoor-side ventilating circuit are spaced and formed. The indoor-side ventilating circuit is used for forming flow of indoor air to perform heat exchange, and the outdoor-side ventilating circuit is used to form flow of outdoor air to perform heat exchange. The main body is installed on the outdoor side of a wall which partitions the indoor side and the outdoor side.

The aforementioned indoor-side ventilating circuit is constituted by an indoor-side air suction port and an indoor-side air blowoff port formed in the front (on the wall side) of the main body, an indoor-side heat exchanger disposed in the main body for forming a refrigerating cycle, and an indoor-side air blower disposed in the main body. Ducts are attached to the indoor-side air suction port and the indoor-side air blowoff port, respectively. The wall is formed with openings through which the ducts extend, and through these ducts the heat exchange on the indoor side is performed.

The aforementioned outdoor-side ventilating circuit is constituted by an outdoor-side air suction port formed in the front of the main body, an outdoor-side air blowoff port formed in the rear of the main body, an outdoor-side heat exchanger disposed in the main body for forming a refrigerating cycle, and an outdoor-side air blower disposed in the main body.

Between the indoor-side ventilating circuit and the outdoor-side ventilating circuit, there is installed a compressor which constitutes a refrigerating cycle, together with the indoor-side heat exchanger and the outdoor-side heat exchanger.

With the aforementioned arrangement, heat is exchanged by the refrigerating cycle so that, during air conditioning, cooled air is supplied into a room and heated air is discharged from the room.

The aforementioned conventional integrated air conditioner, however, has the following problems:

1. The resistance of air flowing through ducts attached to the indoor-side air suction and blowoff ports is large, so a sufficient quantity of air cannot be secured;

2. If the number of rotations of the indoor-side air blower is increased to secure a sufficient quantity of air, the sound of the indoor-side air blower will propagate through the duct and the indoor noise level will rise; and 3. The aforementioned layout of the indoor-side and outdoor-side heat exchangers is not well-suited to be compact, and sufficient ability to exchange heat cannot be obtained in a limited space.

DISCLOSURE OF THE INVENTION

The objective of the present invention is to provide an integrated air conditioner having enhancement in air quantity performance, reduction in noise, enhancement in heat exchanging ability, compact structure, and simplified installing operation, while overcoming the aforementioned problems.

To achieve these and other objectives, the main body of the integrated air conditioner of the present invention, which is installed outdoors, is equipped with: (1) an indoor-side ventilating circuit constituted by an indoor-side heat exchanger, two indoor-side air blowers with centrifugal fans, an indoor-side suction port, and an indoor-side blowoff port; (2) an outdoor-side ventilating circuit constituted by an outdoor-side heat exchanger, an outdoor-side air blower with an axial-flow fan, an outdoor-side suction port, and an outdoor-side blowoff port; (3) a horizontal compressor for compressing a refrigerant which flows through the indoor-side heat exchanger and the outdoor-side heat exchanger; and (4) ducts for leading the indoor-side suction port and the indoor-side blowoff port to an indoor side. The indoor-side ventilating circuit, the outdoor-side ventilating circuit, and the compressor are provided outdoors.

With arrangement such as this, a large quantity of air can be circulated from the indoor side at a low number of rotations by two centrifugal fans, so a room can be air-conditioned with low noise. In addition, by using a horizontal compressor, the entire main body can easily have a vertical configuration and the installing area is reduced, so the installing performance can be improved.

The above and other objects and advantages of the present invention will become apparent from the following detailed description when read in conjunction with the accompanying drawings.

BRIEF DESCRIPTION OF THE DRAWINGS

FIG. 1(*b*) is a longitudinal sectional view of the integrated air conditioner shown in FIG. 1(*a*);

FIG. 2(*b*) is a cross sectional view of the integrated air conditioner shown in FIG. 2(*a*);

FIG. 3(*b*) is a cross sectional view of the integrated air conditioner shown in FIG. 3(*a*);

FIG. 4(*b*) is a cross sectional view of the integrated air conditioner shown in FIG. 4(*a*);

FIG. 5(*b*) is a cross sectional view of the integrated air conditioner shown in FIG. 5(*a*);

FIG. 6(*b*) is a cross sectional view of the integrated air conditioner shown in FIG. 6(*a*);

FIG. 7(*b*) is a plan view of the integrated air conditioner shown in FIG. 7(*a*);

FIG. 8(*b*) is a plan view of the integrated air conditioner shown in FIG. 8(*a*);

FIG. 9(*b*) is a cross sectional view of the integrated air conditioner shown in FIG. 9(*a*);

FIG. 10(*b*) is a side view of the duct shown in FIG. 10(*a*);

FIG. 10(*c*) is an end view of the duct shown in FIG. 10(*a*);

FIG. 11(*b*) is a cross sectional view of the integrated air conditioner shown in FIG. 11(*a*);

FIG. 12(*b*) is a side view of the duct shown in FIG. 12(*a*);

FIG. 12(*c*) is an end view of the duct shown in FIG. 12(*a*);

FIG. 13(*b*) is a cross sectional view of the integrated air conditioner shown in FIG. 13(*a*);

FIG. 14(*b*) is a cross sectional view of the integrated air conditioner shown in FIG. 14(*a*);

FIG. 15(*b*) is a side view of the integrated air conditioner shown in FIG. 15(*a*);

FIG. 16(*b*) is a plan view of the L-shaped outdoor side heat exchanger element shown in FIG. 16(*a*);

FIG. 16(*c*) is an end view of the L-shaped outdoor side heat exchanger element shown in FIG. 16(*a*);

FIG. 17(*b*) is a side view of the integrated air conditioner shown in FIG. 17(*a*);

FIG. 18(*b*) is a plan view of the U-shaped outdoor side heat exchanger element shown in FIG. 18(*a*); and FIG. 18(*c*) is an end view of the U-shaped outdoor side heat exchanger element shown in FIG. 18(*a*).

DESCRIPTION OF THE EMBODIMENTS (Embodiment 1)

Figure 1A:
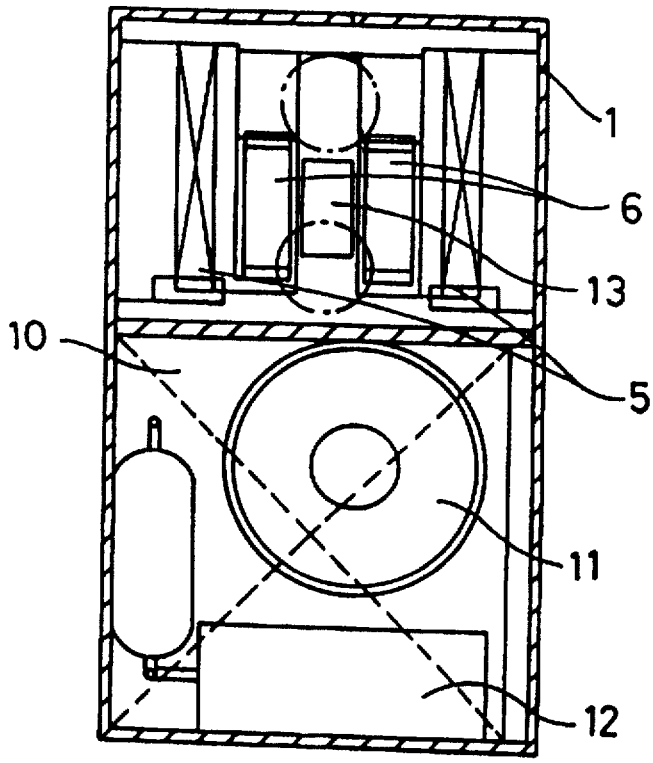
FIG. 1(*a*) is a front view of an integrated air conditioner in a first embodiment of the present invention.

A first embodiment of the present invention will be described based on FIG. 1*a* and FIG. 16.

In the figures, reference numeral 1 denotes the main body of an integrated outdoor air conditioner in the form of a vertical box shape. In the main body 1, an indoor-side ventilating circuit 4 and an outdoor-side ventilating circuit 9 are vertically spaced and disposed. The indoor-side ventilating circuit 4 is used for forming flow of indoor air to perform heat exchange, while the outdoor-side ventilating circuit 9 is used to form flow of outdoor air to perform heat exchange. This main body 1 is installed on the outdoor side of a wall W which partitions the indoor side and the outdoor side.

An indoor-side suction port 2 and an indoor-side blowoff port 3 are formed in the front upper portion (on the wall side) of the main body 1. An indoor-side heat exchanger 5 and two indoor-side air blowers 6 with centrifugal fans, which constitute a well-known refrigerating cycle, are disposed in the inner upper portion of the main body 1. The aforementioned indoor-side ventilating circuit 4 is constituted by the aforementioned indoor-side suction port 2, the indoor-side heat exchanger 5, the two indoor-side air blowers 6 with centrifugal fans, and the indoor-side blowoff port 3. A lower duct 15 which leads into a room is attached to the indoor-side suction port 2, and an upper duct 16 which leads into a room is attached to the indoor-side blowoff port 3. For this reason, the wall W is formed with upper and lower openings through which the upper and lower ducts 16 and 15 extend. Through these ducts 15 and 16 the heat exchange on the indoor side is performed. The air flow on the indoor side is indicated by arrows A.

An outdoor-side suction port 7 is formed in the front lower portion of the main body 1, and an outdoor-side blowoff port 8 is formed in the rear lower portion of the main body 1. As with the indoor side, an outdoor-side heat exchanger 10 and an outdoor-side air blower 11 are disposed in the inner lower portion of the main body 1 as with the indoor side. The aforementioned outdoor-side ventilating circuit 9 is constituted by the aforementioned outdoor-side suction port 7, the outdoor-side heat exchanger 10, the outdoor-side air blower 11, and the outdoor-side blowoff port 8. The air flow on the outdoor side is indicated by an arrow B.

Furthermore, on the inner bottom of the main body 1 there is installed a horizontal compressor 12, which constitutes a refrigerating cycle, together with the aforementioned indoor-side heat exchanger 5 and outdoor-side heat exchanger 10. With the aforementioned refrigerating cycle, heat is exchanged during the time indoor air flows through the aforementioned indoor-side ventilating circuit 4, and during air conditioning, the indoor air becomes cooled air, which is supplied into the room. Also, during the time outdoor air flows through the aforementioned ventilating circuit 9, heat is exchanged. During air conditioning, the outdoor air becomes heated air, which is discharged from the room.

Figure 1B:
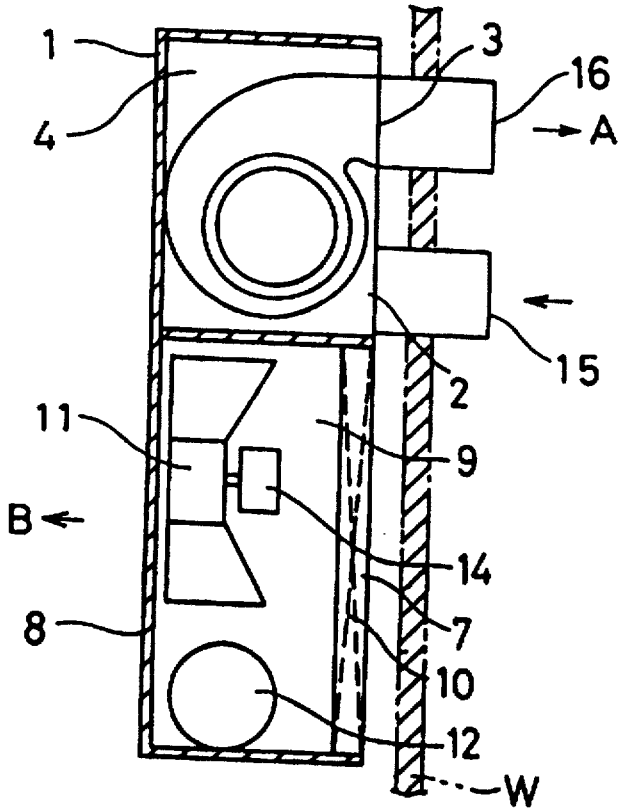

In FIG. 1*a* and FIG. 1*b*, reference numeral 13 denotes an upper fan motor, which drives the aforementioned indoor-side air blowers 6 having centrifugal fans. The opposite ends of the drive shaft of the fan motor 13 are coupled to the respective rotational shafts of the centrifugal fan type indoor-side air blowers 6. Reference numeral 14 denotes a lower fan motor, which drives the aforementioned outdoor-side air blower 11 and constitutes an axial flow fan.

According to arrangement such as this, a large quantity of air can be circulated from the indoor side at a low number of rotations by the two centrifugal fan type indoor-side air blowers 6, so the room can be air-conditioned with low noise. In addition, because the two centrifugal fan type indoor-side air blowers 6 are driven by employing the double-shaft fan motor 13, high efficiency is obtained and less consumption power is needed. Furthermore, by using the horizontal compressor 12, the entire main body 1 can easily have a vertical configuration and the installing area is reduced, so the installing performance can be improved.

(Embodiment 2)

A second embodiment of the present invention will be described based on FIG. 2*a* and FIG. 2*b*.

In the figures, reference numeral 1 denotes the main body of an integrated outdoor air conditioner in the form of a horizontal box shape. In the main body 1, an indoor-side ventilating circuit 4, a compressor 12, and an outdoor-side ventilating circuit 9 are horizontally spaced and disposed. The indoor-side ventilating circuit 4 is used for forming flow of indoor air to perform heat exchange, while the outdoor-side ventilating circuits 9 are used to form flow of outdoor air to perform heat exchange. This main body 1 is installed on the outdoor side of a wall W which partitions the indoor side and the outdoor side.

An indoor-side suction port 2 and an indoor-side blowoff port 3 are formed in the front right portion (on the wall side) of the main body 1. An indoor-side heat exchanger 5 and two centrifugal fan type indoor-side air blowers 6, which constitute a well-known refrigerating cycle, are disposed in the main body 1 or the inner right portion of the main body 1. The aforementioned indoor-side ventilating circuit 4 is constituted by the aforementioned indoor-side suction port 2, the indoor-side heat exchanger 5, the two centrifugal fan type indoor-side air blowers 6, and the indoor-side blowoff port 3. A duct 15 which leads into the room is attached to the indoor-side suction port 2, and duct 16 which leads into the room is attached to the indoor-side blowoff port 3. For this reason, the wall W is formed with upper and lower openings through which the upper and lower ducts 16 and 15 extend. Through these ducts 15 and 16 the heat exchange on the indoor side is performed. The air flow on the indoor side is indicated by arrows A.

An outdoor-side blowoff port 7 is formed in the front left portion of the main body 1, and an outdoor-side suction port 8 is formed in the rear left portion of the main body 1. As with the indoor side, an outdoor-side heat exchanger 10 and an outdoor-side air blower 11 are disposed in the inner left portion of the main body 1. The aforementioned outdoor-side ventilating circuit 9 is constituted by the aforementioned outdoor-side suction port 8, the outdoor-side heat exchanger 10, the outdoor-side air blower 11, and the outdoor-side blowoff port 7. The air flow on the outdoor side is indicated by arrows B.

Furthermore, between the indoor-side ventilating circuit 4 and the outdoor-side ventilating circuit 9, there is installed the horizontal compressor 12, which constitutes a refrigerating cycle, together with the aforementioned indoor-side heat exchanger 5 and outdoor-side heat exchanger 10. With the aforementioned refrigerating cycle, heat is exchanged during the time indoor air flows through the aforementioned indoor-side ventilating circuit 4, and during air conditioning, the indoor air becomes cooled air, which is supplied into the room. Also, during the time outdoor air flows through the aforementioned ventilating circuit 9, heat is exchanged. During air conditioning, the outdoor air becomes heated air, which is discharged from the room.

Figure 2A:
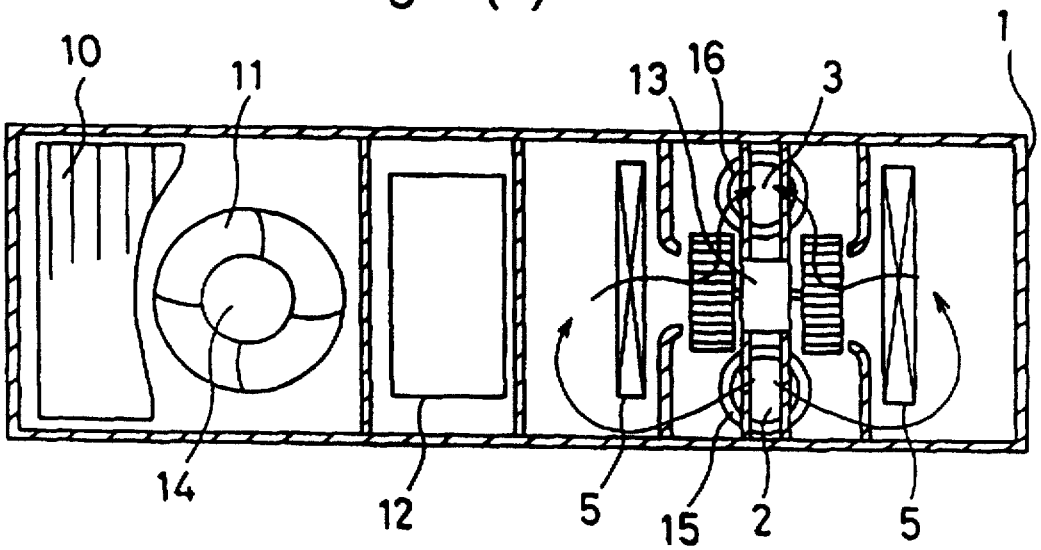
FIG. 2(*a*) is a front view of an integrated air conditioner in a second embodiment of the present invention.
Figure 2B:
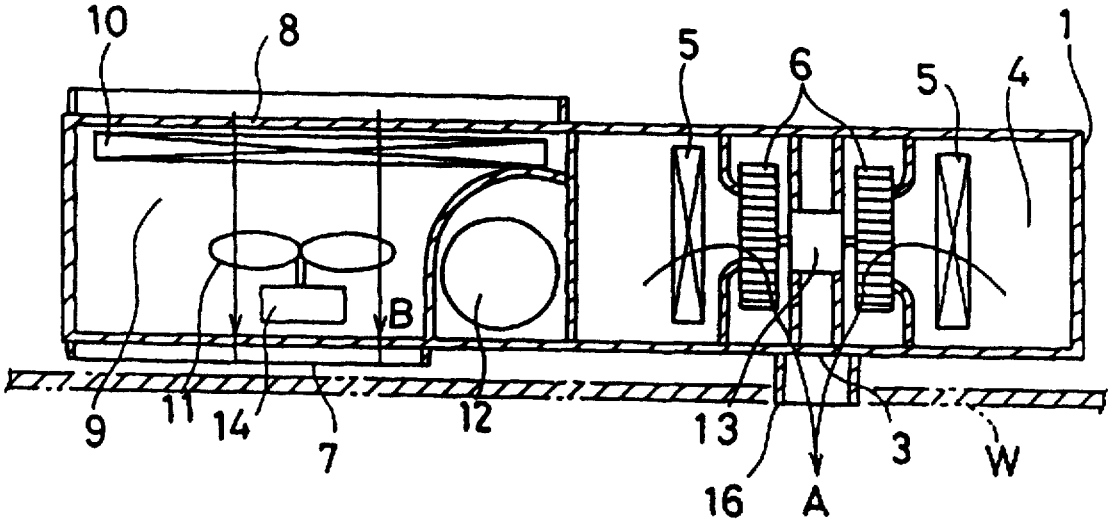

In FIG. 2*a* and FIG. 26, reference numeral 13 denotes a fan motor, which drives the aforementioned two centrifugal fan type indoor-side air blowers 6. The opposite ends of the drive shaft of the motor 13 are coupled to the respective rotational shafts of the centrifugal fan type indoor-side air blowers 6. Reference numeral 14 denotes a fan motor, which drives the aforementioned outdoor-side air blower 11 and constitutes an axial flow fan.

In accordance with the arrangement of the second embodiment, by using the vertical compressor 12, the main body 1 can easily have a horizontal configuration and has the advantage that it can be hung on a wall in a narrow space. In addition, because the compressor 12 is positioned between the indoor-side ventilating circuit 4 and the outdoor-side ventilating circuit 9, the piping for the aforementioned refrigerating cycle can be shortened, furthermore the weight balancing of the main body 1 becomes improved, and the wall hanging performance of the main body 1 can be improved.

(Embodiment 3)

A third embodiment of the present invention will be described based on FIGS. 3*a*–4*b*.

Figure 3A:
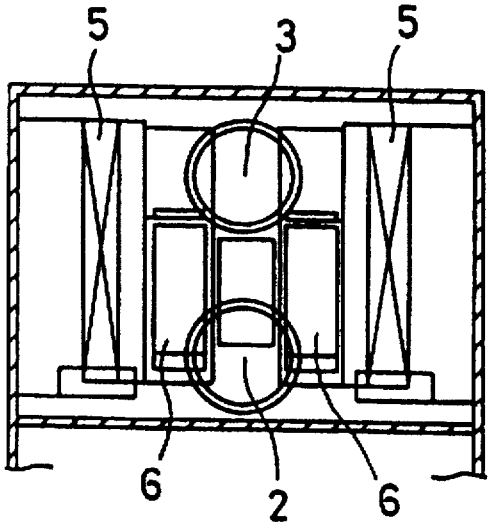
FIG. 3(*a*) is a front view of an integrated air conditioner in a third embodiment of the present invention.
Figure 3B:
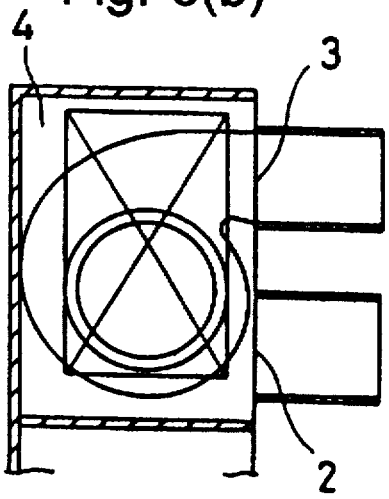

The third embodiment differs from the aforementioned first or the second embodiment in the layout in the indoor-side ventilating circuit 4. In FIG. 3*a* and FIG. 3*b* two I-shaped indoor-side heat exchangers 5 are disposed so as to surround the suction portions of the two centrifugal type indoor-side air blowers 6, and in FIG. 4*a* and FIG. 4*b* a U-shaped indoor-side heat exchanger 5 is disposed so as to surround the suction portions of the two centrifugal type indoor-side air blowers 6.

According to the arrangement of the third embodiment, there are the following advantages in addition to the advantages of the first or the second embodiment. The single U-shaped indoor-side heat exchangers 5 is excellent in moss producibility, so the assembling of the main body also becomes easy and the cost can be reduced. Also, the two I-shaped indoor-side heat exchanger 5 are excellent in storage performance, so this embodiment can be made compact. In addition, because the I-shaped indoor-side heat exchangers 5 or the U-shaped indoor-side heat exchanger 5 is disposed around the suction portions of the two centrifugal fan type indoor-side air blowers 6, a substantially uniform air speed distribution is obtained and thus the efficiency of the heat exchanger can be enhanced.

(Embodiment 4)

Figure 4A:
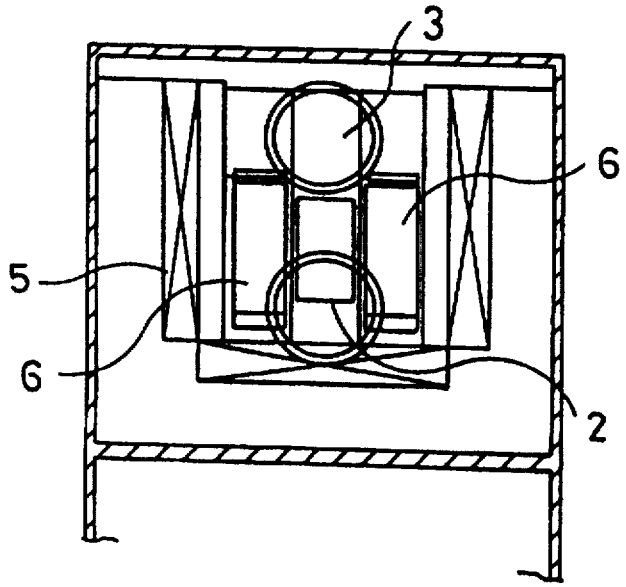
FIG. 4(*a*) is a front view of an integrated air conditioner in a third embodiment of the present invention.
Figure 4B:
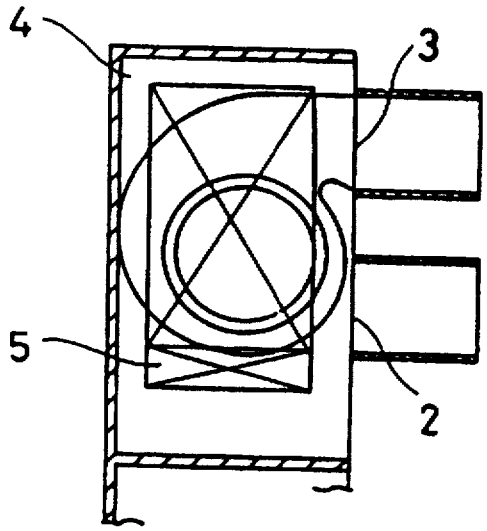
Figure 5A:
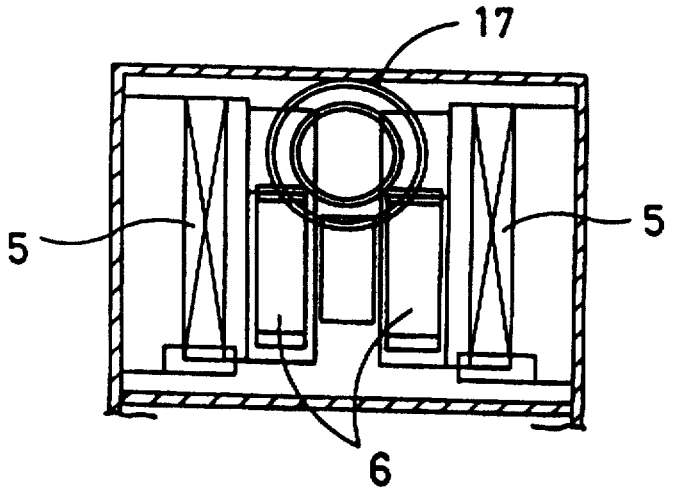
FIG. 5(*a*) is a front view of an integrated air conditioner in a fourth embodiment of the present invention.
Figure 5B:
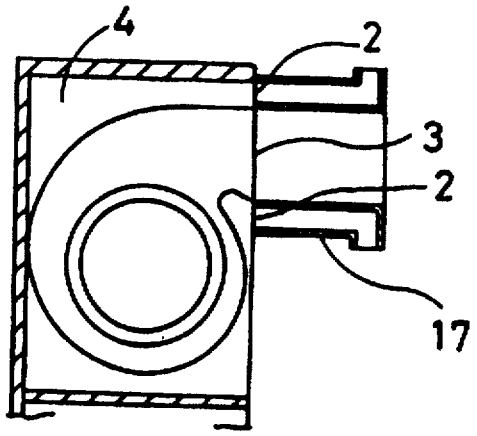

A fourth embodiment of the present invention will be described based on FIGS. 4*a* and 5*b*.

The fourth embodiment differs from the aforementioned first or the second embodiment in the layout in the indoor-side ventilating circuit 4. Instead of the ducts 15 and 16, there is disposed a double duct 17 which consists of an outer tube leading to the indoor-side suction portion 2 and an inner tube leading to the blowoff port 3. Through this double duct 17 the heat exchange on the indoor side is performed.

According to the arrangement of the fourth embodiment, there are the following advantages in addition to the advantages of the first or the second embodiment. Heat is exchanged between hot air or cooled air flowing through the inner tube of the double duct 17 and room-temperature air flowing through the outer tube, however, a loss of heat is very small because the air is supplied to the main body 1. Also, the inner surface of the outer tube is almost near room temperature, so there is little possibility that heat will escape outside. Therefore, heat insulating material becomes unnecessary and the cost can be reduced. In addition, because heat insulating material is not needed, the opening of the wall for passing the double duct 17 therethrough can be reduced in diameter and furthermore only a single opening is needed, so the installing operation can be made easier.

(Embodiment 5)

Figure 6A:
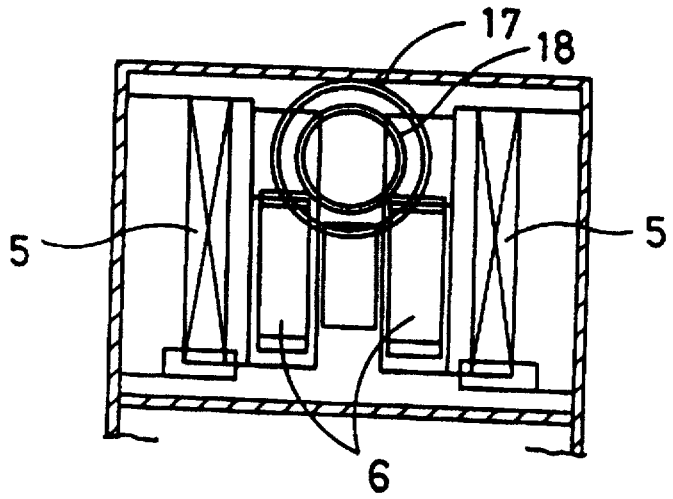
FIG. 6(*a*) is a front view of an integrated air conditioner in a fifth embodiment of the present invention.
Figure 6B:
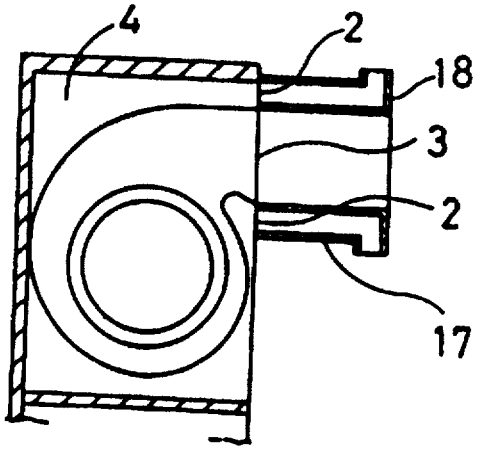

A fifth embodiment of the present invention will be described based on FIG. 6*a* and FIG. 6*b*.

The fifth embodiment differs from the aforementioned fourth embodiment in that, in the double duct 17 of the indoor-side ventilating circuit 4, an inner tube 18 which separates the inner and outer sides of the double duct 17 is formed with a porous material.

According to the arrangement of the fifth embodiment, there are the following advantages in addition to the advantages of the first, the second, or the fourth embodiment. Since the inner tube 18 for separating the outside and the inside is formed with a porous material, the noise propagating through the double duct 17 is absorbed, so noise can be reduced. In addition, air quantity performance per noise can be enhanced.

(Embodiment 6)

Figure 7A:
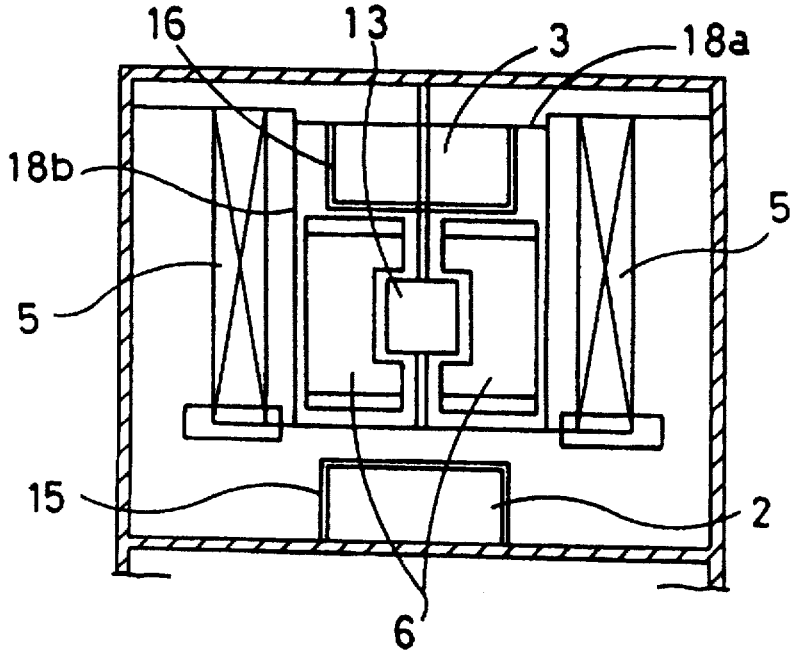
FIG. 7(*a*) is a front view of an integrated air conditioner in a sixth embodiment of the present invention.
Figure 7B:
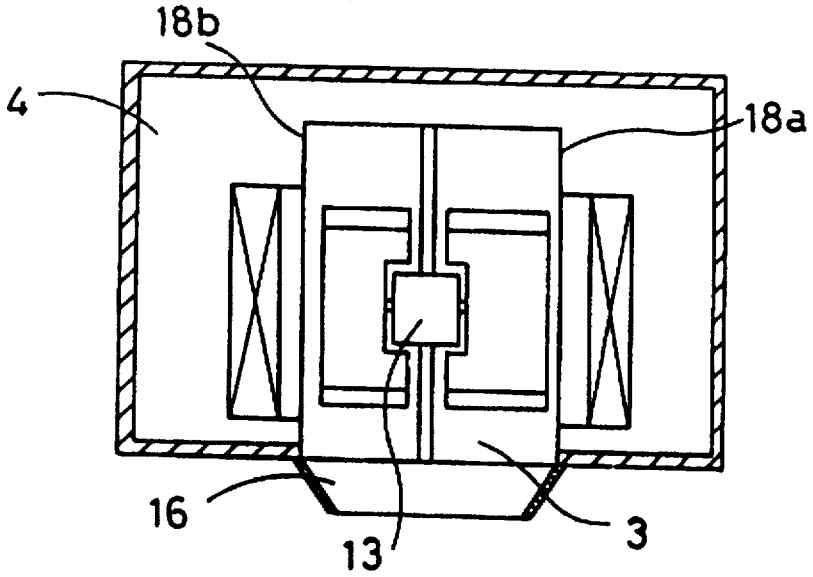

A sixth embodiment of the present invention will be described based on FIG. 7*a* and FIG. 7*b*.

The sixth embodiment differs from the aforementioned first or the second embodiment in that, in the indoor-side ventilating circuit 4, the two centrifugal fan type indoor-side air blowers 6 are disposed so as to surround the fan motor 13 which drives the aforementioned indoor-side air blowers 6 and in that indoor-side scroll casings 18*a* and 18*b* surrounding the aforementioned indoor-side air blowers 6 are likewise disposed so as to surround the fan motor 13.

According to the arrangement of the sixth embodiment, there are the following advantages in addition to the advantages of the first or the second embodiment. The blades of the two centrifugal indoor-side air blowers 6 can be made longer maximally in a limited space, so an efficient indoor-side ventilating circuit 4 can be formed. Furthermore, since the air streams blown from the two centrifugal fans merge in one flow without substantially colliding to each other, a loss of pressure due to confluent streams can be eliminated and thus the efficiency of the indoor-side ventilating circuit 4 can be improved. Furthermore, a rise in the noise level can be almost eliminated. In addition, air quantity performance per noise can be enhanced.

(Embodiment 7)

Figure 8A:
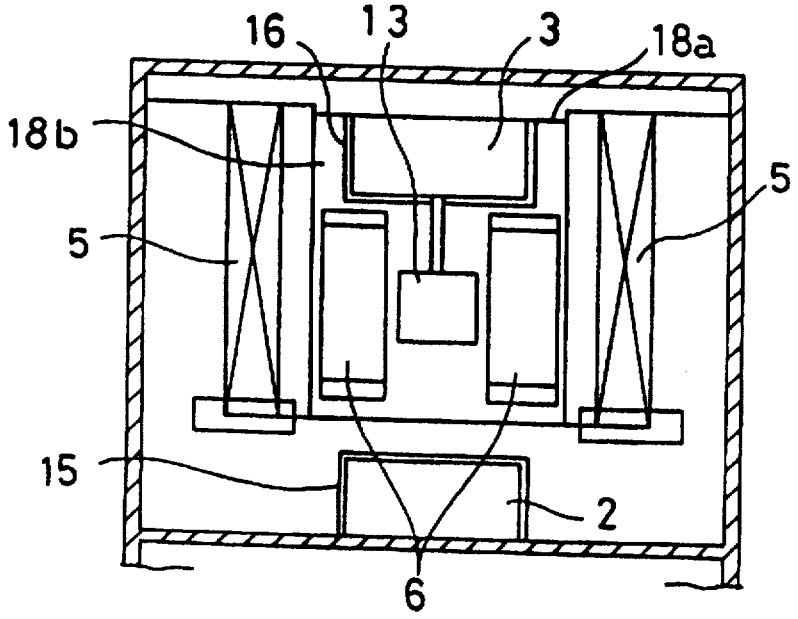
FIG. 8(*a*) is a front view of an integrated air conditioner in a seventh embodiment of the present invention.
Figure 8B:
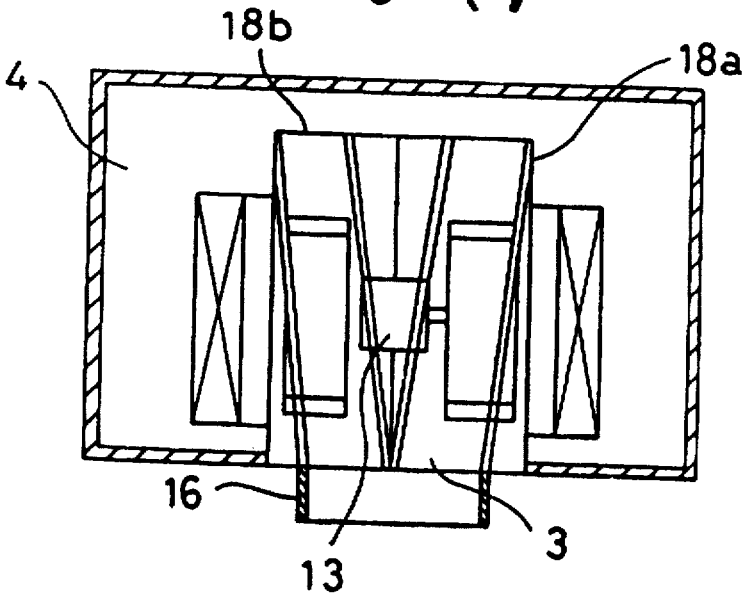
Figure 9A:
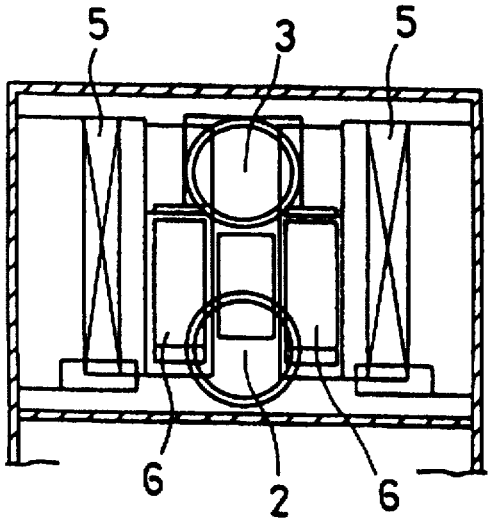
FIG. 9(*a*) is a front view of an integrated air conditioner in an eighth embodiment of the present invention.
Figure 9B:
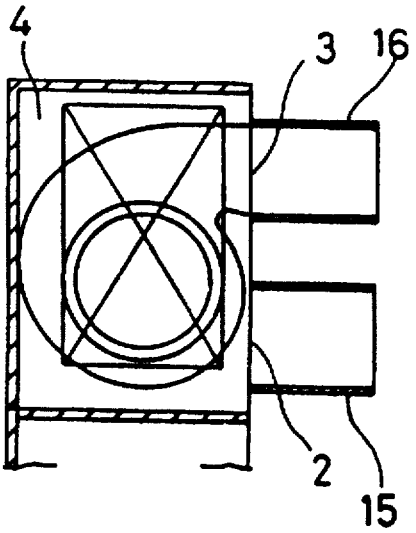

A seventh embodiment of the present invention will be described based on FIG. 8*a* and FIG. 8*b*.

The seventh embodiment differs from the aforementioned first or the second embodiment in that, in the indoor-side ventilating circuit 4, two indoor-side scroll casings 18*a* and 18*b* surrounding the two centrifugal fan type indoor-side blowers 6 are disposed so that they gradually go toward each other and merge at the indoor-side blowoff port 3.

According to the arrangement of the seventh embodiment, there are the following advantages in addition to the advantages of the first or the second embodiment. Since the two indoor-side scroll casings 18*a* and 18*b* gradually go toward each other and merge, a loss of bending and a loss of confluence can be almost eliminated. Therefore, the efficiency of the indoor-side ventilating circuit 4 can be improved and air quantity performance can also be improved.

(Embodiment 8)

An eighth embodiment of the present invention will be described based on FIGS. 9*a*–10*c*.

Figure 10A:
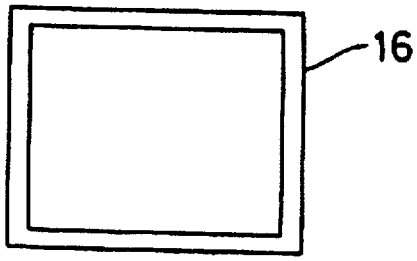
FIG. 10(*a*) is an enlarged front view of a duct of the integrated air conditioner in the eighth embodiment of the present invention.
Figure 10B:
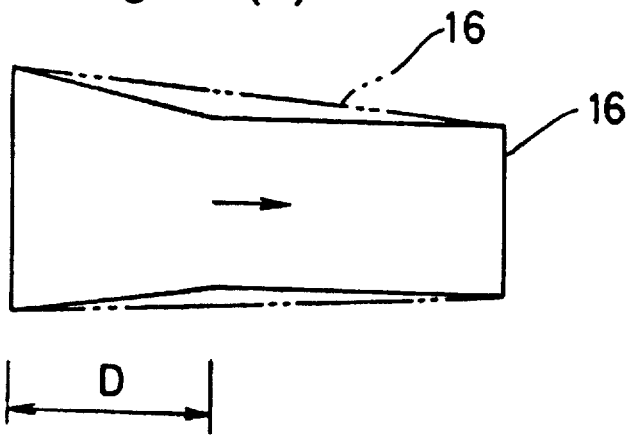
Figure 10C:
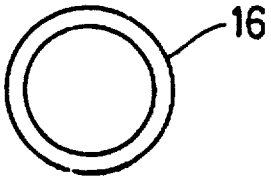
Figure 11A:
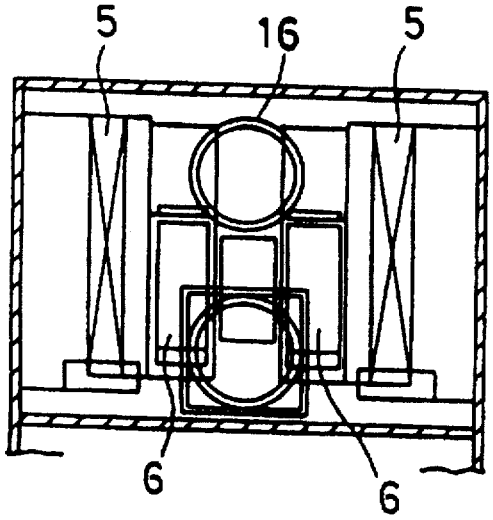
FIG. 11(*a*) is a front view of an integrated air conditioner in a ninth embodiment of the present invention.
Figure 11B:
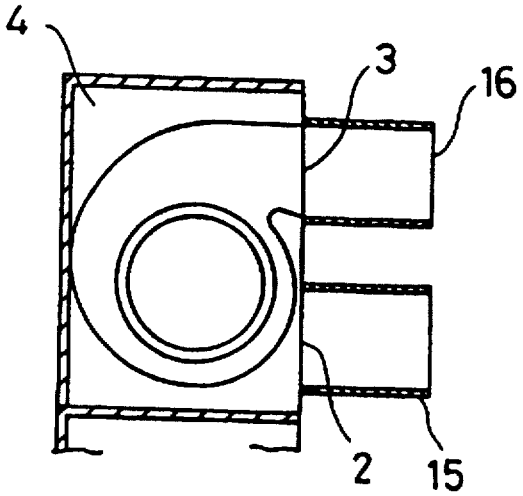

The eighth embodiment differs from the aforementioned first or the second embodiment in that, in the indoor-side ventilating circuit 4, the duct 16 which is attached to the indoor-side blowoff port 3 is formed into a duct which is gradually reduced from a square duct portion to a circular duct portion over a length which extends from the main body 1 by distance D toward the inside, as shown in FIG. 10*b*. The arrow in FIG. 10(*b*) represents a direction of air flow.

According to the arrangement of the eighth embodiment, there are the following advantages in addition to the advantages of the first or the second embodiment. It is desired that the blowoff portion of the centrifugal fan type indoor-side blower 6 is generally square in shape and the indoor blowoff port is generally circular in shape and reduced in diameter. Therefore, the duct 16 is gradually reduced from the square duct portion toward the circular duct portion and leads to the indoor blowoff port, whereby air flow turbulence can be reduced and the resistance of air flow in the duct 16 can be reduced. Therefore, air quantity performance can be improved.

Note that, as shown by two-dot chain lines in FIG. 10(*b*), the duct 16 can also be formed into a duct which gradually varies its section from a square duct to a circular duct and leads to an indoor blowoff port.

(Embodiment 9)

A ninth embodiment of the present invention will be described based on FIGS. 11*a* –12*c*.

Figure 12A:
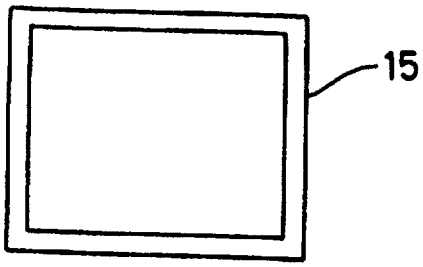
FIG. 12(*a*) is an enlarged front view of a duct of the integrated air conditioner in the ninth embodiment of the present invention.
Figure 12B:
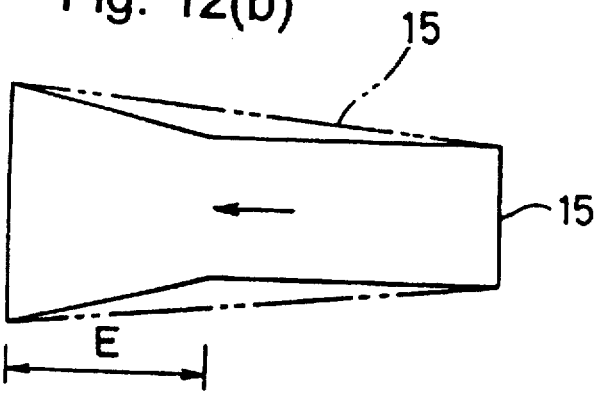
Figure 12C:
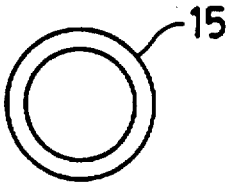

The ninth embodiment differs from the aforementioned first or the second embodiment in that, in the indoor-side ventilating circuit 4, the duct 15 which is attached to the indoor-side suction port 2 is formed into a duct which is gradually enlarged from a circular duct portion to a square duct portion over distance E which leads to the main body 1, as shown in FIG. 12. The arrow in FIG. 12(*b*) represents a direction of air flow.

According to the arrangement of the ninth embodiment, there are the following advantages in addition to the advantages of the first or the second embodiment. It is desired that the indoor suction port is generally circular in shape and reduced in diameter. By enlarging the suction port 2 of the main body 1, air can be uniformly introduced in the heat exchanger 5 and the ability of the heat exchanger can be enhanced. Also, if the front surface of the heat exchanger 5 is square in shape, it is desired that the suction port 2 of the main body 1 has a square shape so that it corresponds to the front shape of the heat exchanger 5. Therefore, the duct 15 is gradually enlarged from the circular duct portion toward the square duct portion between the wall W and the main body 1, whereby air flow turbulence can be reduced and the resistance of air flow in the duct 15 can be reduced. Therefore, air quantity performance can be improved.

Note that, as shown by two-dot chain lines in FIG. 12(*b*), the duct 15 can also be formed into a duct which gradually varies its section from a circular duct to a square duct.

(Embodiment 10)

Figure 13A:
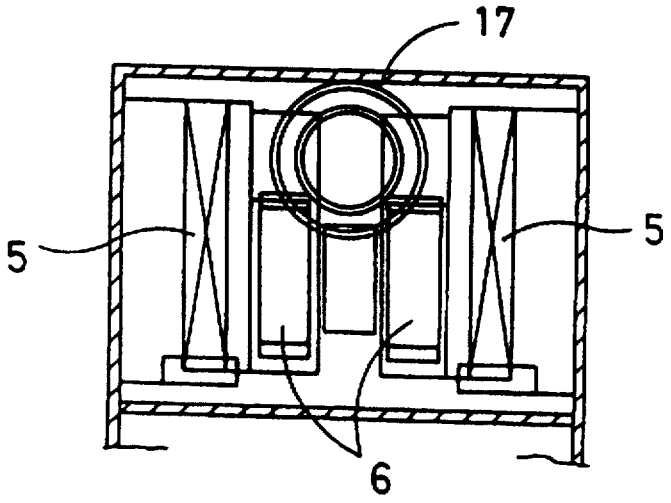
FIG. 13(*a*) is a front view of an integrated air conditioner in a tenth embodiment of the present invention.
Figure 13B:
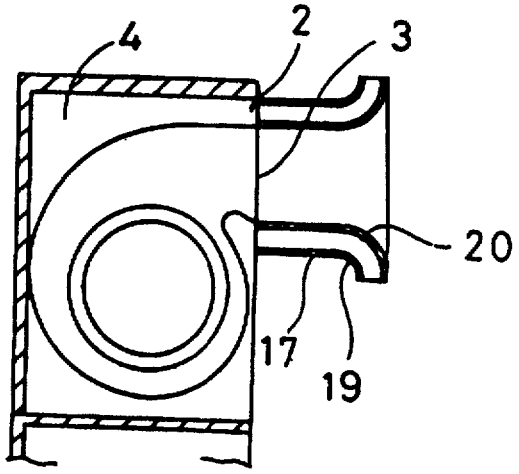

A tenth embodiment of the present invention will be described based on FIG. 13*a* and FIG. 13*b*.

The tenth embodiment differs from the aforementioned first or the second embodiment in that, in the indoor-side ventilating circuit 4, instead of the ducts 15 and 16 there is disposed a double duct 17 which consists of an outer tube leading to the indoor-side suction portion 2 and an inner tube leading to the blowoff port 3 and that circular arc-shaped orifices 19 and 20 are disposed in the indoor suction port and blowoff port of the double duct 17.

According to the arrangement of the tenth embodiment, there are the following advantages in addition to the advantages of the first or the second embodiment. Because the circular arc-shaped orifices 19 and 20 are disposed in the indoor suction port and the indoor blowoff port, air is smoothly introduced into the suction port and thus air resistance is reduced. Also, the noise that is caused due to the injected flow from the blowoff port is reduced. That is, air quantity performance can be enhanced, and at the same time, noise can be reduced and air quantity performance per noise can be considerably enhanced.

(Embodiment 11)

Figure 14A:
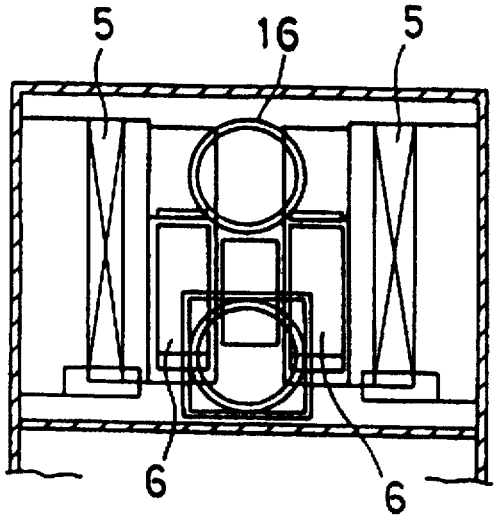
FIG. 14(*a*) is a front view of an integrated air conditioner in an eleventh embodiment of the present invention.
Figure 14B:
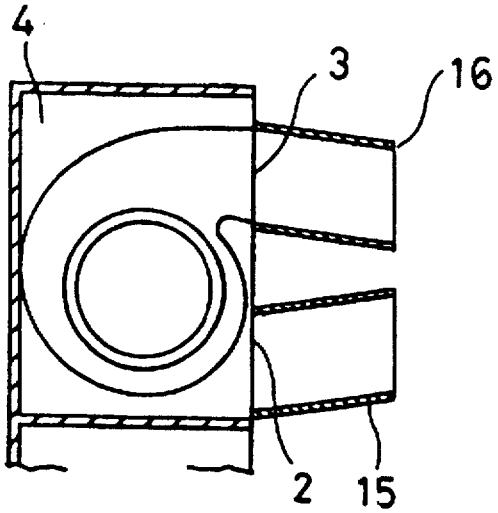

An eleventh embodiment of the present invention will be described based on FIG. 14*a* and FIG. 14*b*.

The eleventh embodiment differs from the aforementioned first or the second embodiment in that, in the indoor-side ventilating circuit 4, the ducts 15 and 16 are formed with elastic material so that they can be bent and twisted.

According to the arrangement of the eleventh embodiment, there are the following advantages in addition to the advantages of the first or the second embodiment. The ducts 15 and 16, which lead from the suction port 2 and the blowoff port 3 of the main body 1 to an indoor suction port and an indoor blowoff port, are formed with elastic material, so the positions of the openings of the wall W which partitions the indoor side and the outdoor side for passing the ducts 15 and 16 therethrough can be flexibly selected with respect to the installing position of the main body 1. As a result, the flexibility of the installing performance is increased and the installing operation can be facilitated.

(Embodiment 12)

A twelfth embodiment of the present invention will be described based on FIGS. 15*a*–18*c*.

Figure 15A:
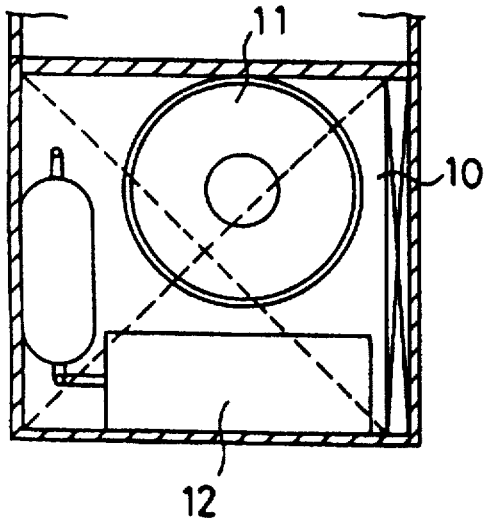
FIG. 15(*a*) is a front view of an integrated air conditioner in a twelfth embodiment of the present invention.
Figure 15B:
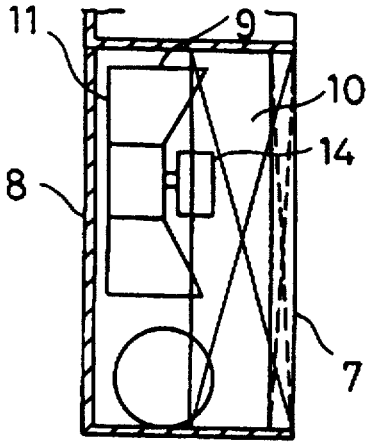
Figure 16A:
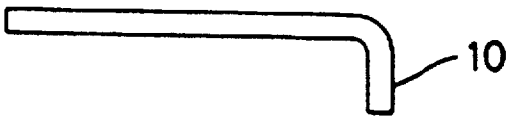
FIG. 16(*a*) is an elevational view of an L-shaped outdoor side heat exchanger element of the integrated air conditioner in the twelfth embodiment of the present invention.
Figure 16B:
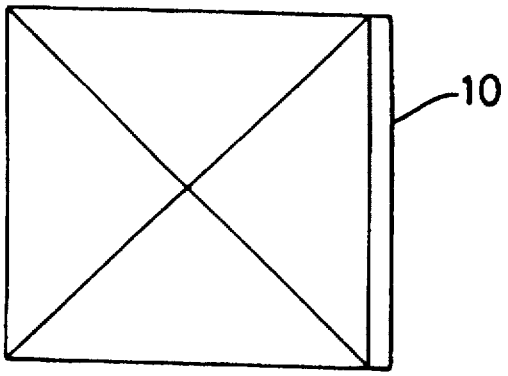
Figure 16C:
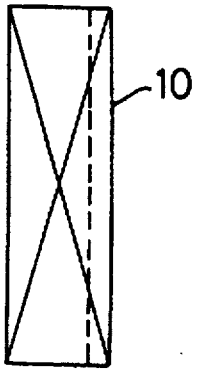
Figure 17A:
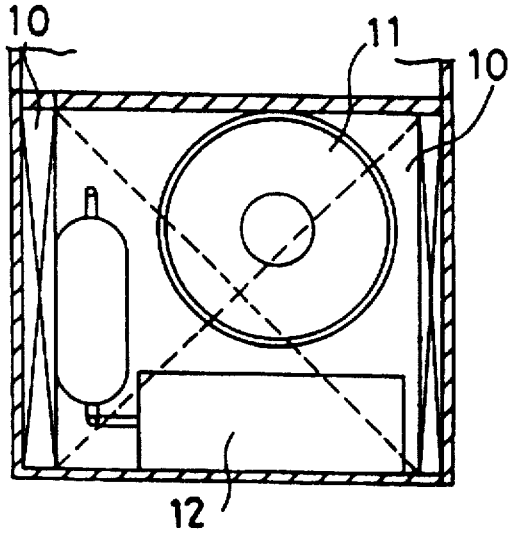
FIG. 17(*a*) is a front view of the integrated air conditioner showing a modification of the twelfth embodiment of the present invention.
Figure 17B:
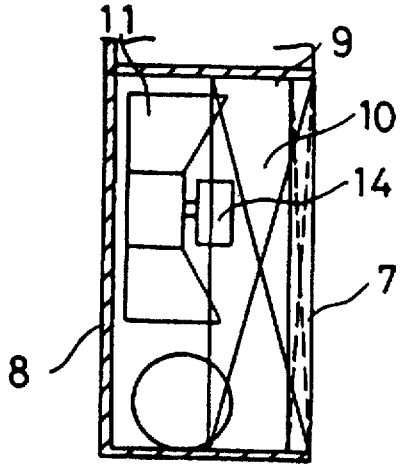
Figure 18A:
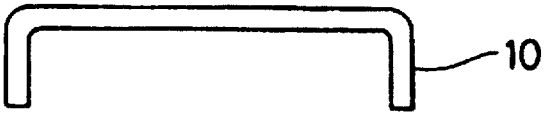
FIG. 18(*a*) is an elevational view of an U-shaped outdoor side heat exchanger element of a modification of the twelfth embodiment of the present invention.
Figure 18B:
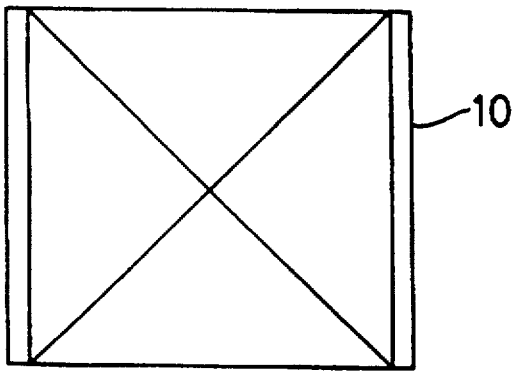
Figure 18C:
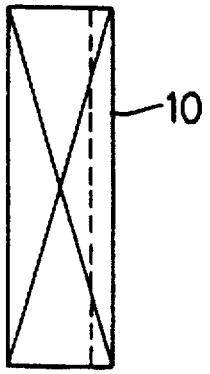

The twelfth embodiment differs from the aforementioned first or the second embodiment in that, in the indoor-side ventilating circuit 9, in FIGS. 15*a–b* the outdoor-side heat exchanger comprises an outdoor-side heat exchanger 10 and an L-shaped outdoor heat exchanger shown in FIGS. 16*a–c* is disposed so as to surround the outdoor-side air blower 11 and in FIGS. 17*a–b* the outdoor-side heat exchanger comprises an outdoor-side heat exchanger 10 and a U-shaped outdoor heat exchanger shown in FIG. 18*a–c* is disposed so as to surround the outdoor air blower 11.

According to the arrangement of the twelfth embodiment, there are the following advantages in addition to the advantages of the first or the second embodiment. In order to sufficiently assure the ability of the heat exchanger, it is effective to surround the axial-flow outdoor-side air blower 11 by a U-shaped heat exchanger when the air blower has a vertical configuration and it is effective to surround the axial-flow outdoor-side air blower 11 by an L-shaped heat exchanger when the air blower has a horizontal configuration.

In addition, with these configurations, air can be sucked not only in one direction but also in two and three directions, so air quantity performance can be enhanced.

While the invention has been described with reference to preferred embodiments thereof, the invention is not to be limited to the details given herein, but may be modified within the scope of the appended claims.

What is claimed is:

1. An integrated air conditioners comprising:

an indoor-side ventilating circuit including two indoor-side heat exchangers two indoor-side air blowers having centrifugal fans with respective rotational shafts coupled to opposite ends of a single fan motor and ducting such that air sucked into said indoor-side ventilating circuit is divided substantially evenly such that approximately half of the air passes through each of said blowers, respectively, thereby providing balanced heat exchanging by said two indoor-side heat exchangers, an indoor-side circular suction port having a cross-sectional area that is substantially smaller than an area of either of said two indoor-side heat exchangers, and an indoor-side circular blowoff port having a cross-sectional area that is substantially smaller than an area of either of said two indoor-side heat exchangers, said two indoor-side heat exchangers being arranged at a suction side of said indoor-side air blowers and perpendicularly to an axis of rotation of said blowers;

an outdoor-side ventilating circuit including an outdoor-side heat exchanger, an outdoor-side air blower with an axial-flow fan, an outdoor-side suction port, and an outdoor-side blowoff port;

a horizontal compressor for compressing a refrigerant which flows through said indoor-side heat exchanger and said outdoor-side heat exchanger; and ducts for leading said indoor-side suction port and said indoor-side blowoff port to an indoor side, wherein said indoor-side ventilating circuit, said outdoor-side ventilating circuit, and said compressor are provided outdoors.

2. An integrated air conditioner, comprising:

an indoor-side ventilating circuit including two indoor-side heat exchangers, two indoor-side air blowers having centrifugal fans with respective rotational shafts coupled to opposite ends of a single fan motor and ducting such that air sucked into said indoor-said ventilating circuit is divided substantially evenly such that approximately half of the air passes through each of said blowers, respectively, thereby providing balanced heat exchanging by said two indoor-side heat exchangers, an indoor-side circular suction port having a cross-sectional area that is substantially smaller than an area of either of said two indoor-side heat exchangers, and an indoor-side circular blowoff port having a cross-sectional area that is substantially smaller than an area of either of said two indoor-side heat exchangers, said two indoor-side heat exchangers being arranged at a suction side of said indoor-aide air blowers and perpendicularly to an axis of rotation of said blowers;

an outdoor-side ventilating circuit including an outdoor-side heat exchanger, an outdoor-side air blower with an axial flow-fan, an outdoor-side suction port, and an outdoor-side blowoff port; and a vertical compressor for compressing a refrigerant which flows through said indoor-side heat exchanger and said outdoor-side heat exchanger, wherein (i) said indoor-side ventilating circuit, said outdoor-side ventilating circuit, and said compressor are provided outdoors, (ii) said indoor-side suction port and said indoor-side blowoff port are constructed so as to lead into a room, and (iii) said compressor is interposed between said indoor-side ventilating circuit and said outdoor-side ventilating circuit.

3. The integrated air conditioner as set forth in claim 1, wherein said indoor-side heat exchanger is formed by two I-shaped heat exchangers or a U-shaped heat exchanger and wherein said two I-shaped heat exchangers or said U-shaped heat exchanger is disposed so as to surround a suction portion of said indoor-side air blower.

4. The integrated air conditioner as set forth in claim 1, wherein said duct is formed by a double duct which comprises an outer tube leading to the indoor-side suction port and an inner tube leading to the indoor-side blowoff port.

5. The integrated air conditioner as set forth in claim 4, wherein the inner tube of said double duct is formed with a porous material.

6. The integrated air conditioner as set forth in claim 1, wherein said fan motor is surrounded by said two indoor-side air blowers with centrifugal fans and scroll casings of said air blowers.

7. The integrated air conditioner as set forth in claim 1, wherein scroll portions of said two indoor-side air blowers with centrifugal fans gradually go toward each other and merge at the blowoff port.

8. The integrated air conditioner as set forth in claim 1, wherein the duct leading to the indoor-side blowoff port is formed of a duct which gradually varies from a square duct portion to a circular duct portion and leads to the indoor-side blowoff port, or of a duct which is gradually reduced from a square duct portion to a circular duct portion and leads to the indoor-side blowoff port.

9. The integrated air conditioner as set forth in claim 1, wherein the duct leading to the indoor-side suction port is formed of a duct which is gradually enlarged between a wall partitioning the duct into an indoor portion and an outdoor portion and a main body, or of a duct which gradually varies from a circular duct portion to a square duct portion.

10. The integrated air conditioner as set forth in claim 1, wherein said duct is formed by a double duct which comprises an outer tube leading to the indoor-side suction port and an inner tube leading to the indoor-side blowoff port, and wherein circular arc-shaped orifices are provided in the indoor suction port and blowoff port of said double duct.

11. The integrated air conditioner as set forth in claim 1, wherein said duct is formed with an elastic material.

12. The integrated air conditioner as set forth in claim 1, wherein said indoor-side heat exchanger is formed by a U-shaped heat exchanger or an L-shaped heat exchanger, and wherein said U-shaped heat exchanger or said L-shaped heat exchanger is disposed so as to surround said outdoor-side air blower.

* * * * *

UNITED STATES PATENT AND TRADEMARK OFFICE

CERTIFICATE OF CORRECTION

PATENT NO. : 5,775,125

DATED : July 7, 1998

INVENTOR(S) : Hirokazu SAKAI and Takashi SUGIO

It is certified that error appears in the above-indentified patent and that said Letters Patent is hereby corrected as shown below:

On the title page, item [73], change "Matsushita Industrial Electric Co., Ltd." to --Matsushita Electric Industrial Co., Ltd.--.

Signed and Sealed this

Twenty-sixth Day of October, 1999

*Attest:*

*Attesting Officer*

Q. TODD DICKINSON

*Acting Commissioner of Patents and Trademarks*